US006336574B1

(12) United States Patent
Hins

(10) Patent No.: US 6,336,574 B1
(45) Date of Patent: Jan. 8, 2002

(54) AUTOMATIC CLOSURE FOR A CONTAINER

(75) Inventor: Johannes Hins, Sundern (DE)

(73) Assignee: Georg Menshen GmbH & Co. KG, Finnentrop (DE)

( * ) Notice: Subject to any disclaimer, the term of this patent is extended or adjusted under 35 U.S.C. 154(b) by 0 days.

(21) Appl. No.: 09/806,855

(22) PCT Filed: Sep. 16, 1999

(86) PCT No.: PCT/EP99/06868

§ 371 Date: Apr. 5, 2001

§ 102(e) Date: Apr. 5, 2001

(87) PCT Pub. No.: WO00/21850

PCT Pub. Date: Apr. 20, 2000

(30) Foreign Application Priority Data

Oct. 8, 1998 (DE) ..... 298 18 005 U

(51) Int. Cl.[7] ..... B67D 3/00
(52) U.S. Cl. ..... 222/518
(58) Field of Search ..... 222/518; 251/303

(56) References Cited

U.S. PATENT DOCUMENTS

| | | | | |
|---|---|---|---|---|
| 3,323,692 A | | 6/1967 | Cook | |
| 3,434,631 A | * | 3/1969 | Merchlewitz | 222/518 |
| 3,964,631 A | * | 6/1976 | Albert | 222/518 |

FOREIGN PATENT DOCUMENTS

| | | |
|---|---|---|
| DE | U1-83047093 | 7/1983 |
| DE | U1-91035988 | 8/1991 |
| DE | A1-4307752 | 9/1994 |
| DE | U1-94143307 | 12/1994 |
| EP | A2810160 | 12/1997 |
| FR | A1-2684080 | 5/1993 |
| GB | A2279339 | 1/1995 |

* cited by examiner

*Primary Examiner*—Philippe Derakshani

(57) ABSTRACT

A self-closing closure which can be integrated into a discharge opening of a container, cap part or the like, and includes an upper wall section (6) containing a through opening (9) and a sealing tappet (11) which protrudes from an inner section (10) of the closure and engages with the through opening from beneath the upper wall section. The configuration of the upper wall section (6), at least on the upper surface thereof, can be adapted to the shape of the wall (3) of the container such as to be flush therewith, and furthermore it is formed elastically deformable at at least an actuating portion (6') thereof so that the actuating portion is deformable in elastically concave manner by an external manual force exerted thereon. A conveying member (13) is provided for converting the concave deformation of the actuating area into a relative movement between the sealing tappet (11) and the through opening (9) so as to release the latter whereby the contents of the container can be discharged.

7 Claims, 2 Drawing Sheets

AUTOMATIC CLOSURE FOR A CONTAINER

This application is the national phase under 35 U.S.C. §371 of PCT International Application No. PCT/EP99/06868 which has an International filing date of Sep. 16, 1999, which designated the United States of America.

BACKGROUND OF THE INVENTION

The invention relates to a self-closing closure which can be integrated into a discharge opening of a container, a cap or the like.

A known closure (DE-A-42 14 153) of the type in question comprises a stiff upper section which is connected via a membrane-like deformable connecting wall to a stiff inner section that can be screwed onto a container neck on the one hand and from which there protrudes a stationary sealing tappet on the other hand. The sealing tappet can engage in a through opening in the upper section so as to seal it when there is no external force acting thereon. By contrast, a lifting force applied to the upper section causes the sealing tappet to be released from its sealing engagement with the through opening. The known closure has a comparatively complicated structure and is difficult to manufacture. It is especially disadvantageous in that it is not suitable for being adapted to a predetermined configuration, e.g. the roundness of a container wall, without substantially affecting the appearance thereof. An self-closing closure having a similar structure is also known from DE-A-23 40 319. The appearance of this closure is substantially spoilt additionally by an externally bare connecting wall.

SUMMARY OF THE INVENTION

An object of the invention is to provide a self-closing closure of the type mentioned hereinabove having a simplified, easy to manufacture and user friendly construction which will enable it to be integrated in and adapted to the configuration of a component whose discharge opening is to be closed.

In accordance with the invention, this object is achieved by a self-closing closure that can be integrated into a discharge opening of a container, cap part or the like, and which includes an upper wall section containing a through opening and a sealing tappet that protrudes from an inner section of the closure and engages with the through opening from beneath the upper wall section, said sealing tappet against a bias force can be moved out of sealing engagement with the through opening by means of a force exerted on the upper wall section, whereby, in accordance with the invention, the configuration of the upper wall section, at least on the upper side thereof, can be adapted to the shape of the outer surface of the container such as to be flush therewith and is formed elastically deformable at at least an actuating portion thereof whereby said actuating portion can be concavely deformed in an elastical manner by means of an external manual force exerted thereon, and in that means are provided for converting the concave deformation of the actuating portion into a relative movement between the sealing tappet and the through opening. The closure has an upper wall section which may be completely or partially deformable so that a force exerted thereon by a finger or thumb of a user will cause a concave indentation therein. By contrast, when such a force is not being exerted, the upper wall section has a substantially smooth outer surface which appears to be a continuation of the adjacent surface of a container wall or of another component the closure is mounted to. Thus the closure scarcely detracts from the outer configuration of the component. The movement produced by the indentation in the upper section as a result of said force is utilised, with the aid of simple means, for producing a relative movement between a through opening in the upper wall section and a sealing tappet co-operating therewith whereby said sealing tappet can be moved out of engagement with the through opening. A particularly preferred embodiment of the invention, because it is expedient to manufacture, envisages that the sealing tappet be held on the inner section of the closure in pivotal manner and that the indentation in the upper wall section be conveyed to the sealing tappet by means of a simple transfer member. In this embodiment, the inner section of the closure together with the sealing tappet could be an integral element of the component so that only the upper wall section would need to be added. However, the upper wall section and the inner section of the closure could also be separate parts which are inserted subsequently into a discharge opening in the relevant component. In any case, an aesthetic, attractive, smooth outer surface will be obtained in the vicinity of the discharge opening, whereby said surface is matched to the configuration of the component to a maximum possible extent and can e.g. be printed with advertisements in the same manner as the adjacent wall portion of the component without detracting from the appearance thereof.

DESCRIPTION OF THE PREFERRED EMBODIMENTS

Figure 2:
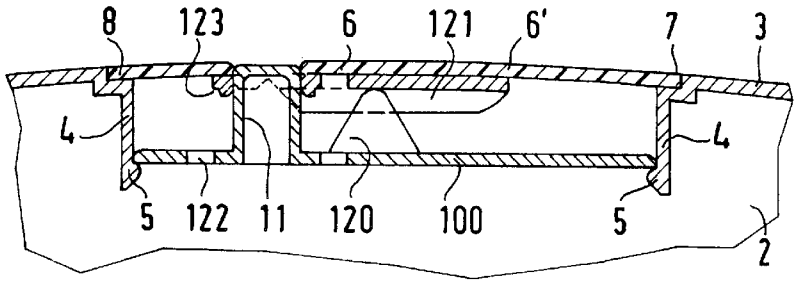

The invention will be explained in detail hereinafter by means of embodiments and the drawing. Although the invention will be described hereinafter in connection with the closure of a discharge opening in a container wall, it should be understood that the invention could also be employed for the purposes of closing other openings or recesses e.g. in closure caps, and consequently it is not limited to the field of application described.

Figure 1:
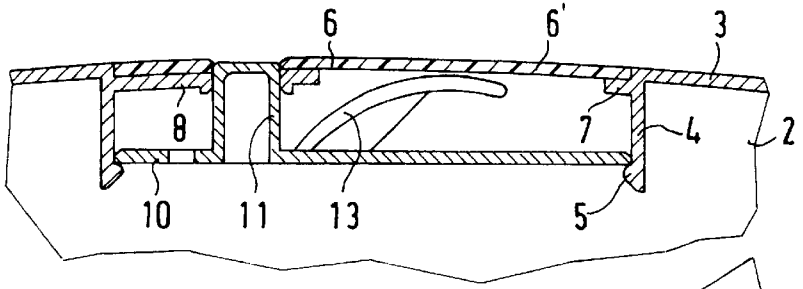
FIGS. 1, 1A show sectional, fragmentary views of a self-closing closure according to a first embodiment of the invention in its closed (FIG. 1) and in it is released position (FIG. 1A), FIGS. 2, 2A views similar to FIGS. 1 and 1A of a self-closing closure according to a second embodiment of the invention, and FIGS. 3, 3A views similar to FIGS. 1 and 1A of a self-closing closure according to a third embodiment of the invention.

As shown in FIG. 1, the self-closing closure of the invention is arranged in a discharge opening (not shown) in the wall 3 of a container 2. The closure comprises an upper wall section 6 which is supported on supports 7 formed on the container 2, whereby, as illustrated, the upper surface of said upper wall section may be aligned with the container wall 3 such as to be flush therewith.

The upper wall section 6 may have any peripheral configuration that is matched to the outline configuration of the discharge opening such as to produce a flush continuation of the domed container wall 3.

A through opening 9 is provided in the upper wall section 6 at a position close to a radially displaced peripheral portion, and a sealing tappet 11 is adapted to engage with said through opening 9 so as to seal it. The sealing tappet 11 is formed on an inner section 10 of the closure, and, in particular, on a resilient coupling member 12 in the form of an e.g. U-shaped cut-out from the inner section 10 of the closure, whereby the coupling member 12, which carries the sealing tappet 11 at one end thereof, is connected to the inner section 10 of the closure cap at its other end. Consequently, the coupling member 12 together with the sealing tappet 11 can be pivoted out from the plane of the inner section 10 of the closure, whereby it will spring back into its starting position in the plane of the inner section 10 of the closure as shown in FIG. 1 due to the natural elasticity of the material when there is no external force exerted upon the coupling member 12. The external force can be applied by the thumb or the finger of the user, as shown in FIG. 1A.

Figure 1A:
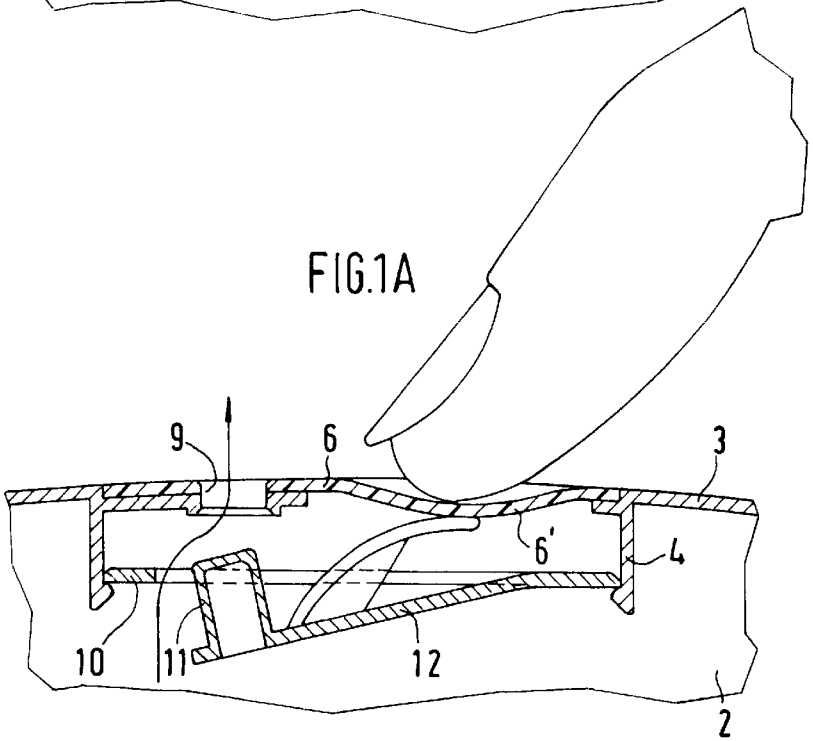

Structurally, the upper wall section 6 is elastic at least in some portions thereof, and/or it consists of an elastic material, e.g. an elastomeric material which flexes under the effects of an external force so as to form an indentation therein that will be referred to hereinafter as an actuating portion 6', as is shown in FIG. 1A. Furthermore, a movement conveying member 13 in the form of a tongue is formed on the coupling member 12, whereby the free end of said conveying member abuts the lower surface of the upper wall section 6 or engages therewith in some other suitable manner, so that a movement of the upper wall section 6 in this actuating portion 6' can lead to a similarly directed movement of the coupling member 12. Due to the elastic properties of the upper wall section 6 on the one hand and that of the coupling member 12 on the other, both of these parts will spring back into the starting position shown in FIG. 1 as soon as the force exerted on the upper wall section 6 is removed. Once the parts have regained their starting position, the sealing tappet 11 will engage with the through opening 9 in the upper wall section 6 so as to seal it. On the other hand, however, the sealing tappet 11 will disengage from the through opening 9 when a force is exerted, so that a medium stored in the container can flow along the sealing tappet 11 and out through the through opening 9, as is indicated by the arrow in FIG. 1A.

If so desired, the upper wall section 6 may be entirely elastic or be elastic only in the actuating portion 6' thereof. Furthermore, for the purposes of mounting the inner section 10 of the closure, a continuous or subdivided latching sleeve 4 having a latching shoulder 5 at the free end thereof may be formed on the container wall 3, whereby said shoulder can engage the inner section 10 of the closure from below.

Figure 2A:
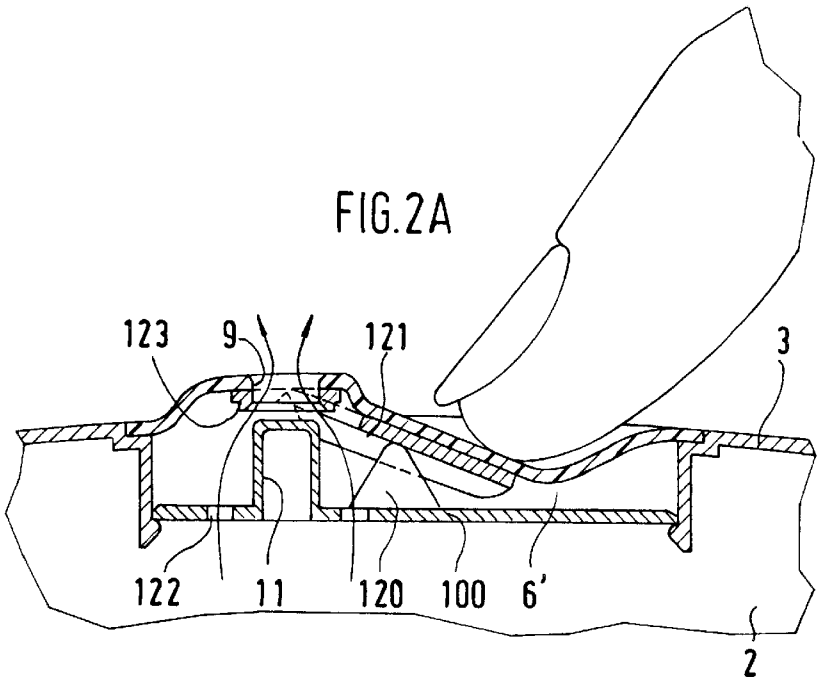

A second embodiment of the invention is shown in FIGS. 2 and 2A wherein same or similar parts bear the same references as were used in the first embodiment and do not have to be described again. In the second embodiment, the inner section 100 of the closure carrying the sealing tappet 11 is substantially rigid so that the sealing tappet 11 is held stationary. On the other hand however, provision is made for the upper wall section 6 to experience a deformation not only in the actuating portion 6' thereof but also in the vicinity of the through opening 9 when a force is exerted thereon, whereby said opening will be raised out of engagement from the sealing tappet 11. In particular, a bracket or support member 120 is formed on the inner section 100 of the closure, and a rocker member 121 that touches the actuating portion 6' of the upper wall section 6 rests on this support member, whereby said rocker member can be swung downwardly about the support 120 when an indentation is produced in the upper wall section 6 as a result of the force exerted by the finger or thumb of a user. This movement of the rocker member 121 manifests itself in the form of a movement in the opposing direction at the other end of the rocker member 121, said latter movement being conveyed to the upper wall section 6 in the vicinity of the through opening 9 thereby causing a convex deformation of the upper wall section 6 at the through opening 9 so that said opening will be moved away from the sealing tappet 11, as is shown in FIG. 2A. In this position, as is indicated by the arrow in FIG. 2A, a medium in the container 2 can flow through one or more openings 122 provided in the inner section 100 of the closure into the region between the inner section of the closure and the upper wall section, and from there, out through the through opening 9. As shown, the rocker member 121 is articulated on a ring element 123 engaging beneath the through opening 9 so as to control the lifting movement of the upper wall section 6 in the vicinity of the through opening 9.

Figures 3, 3A:
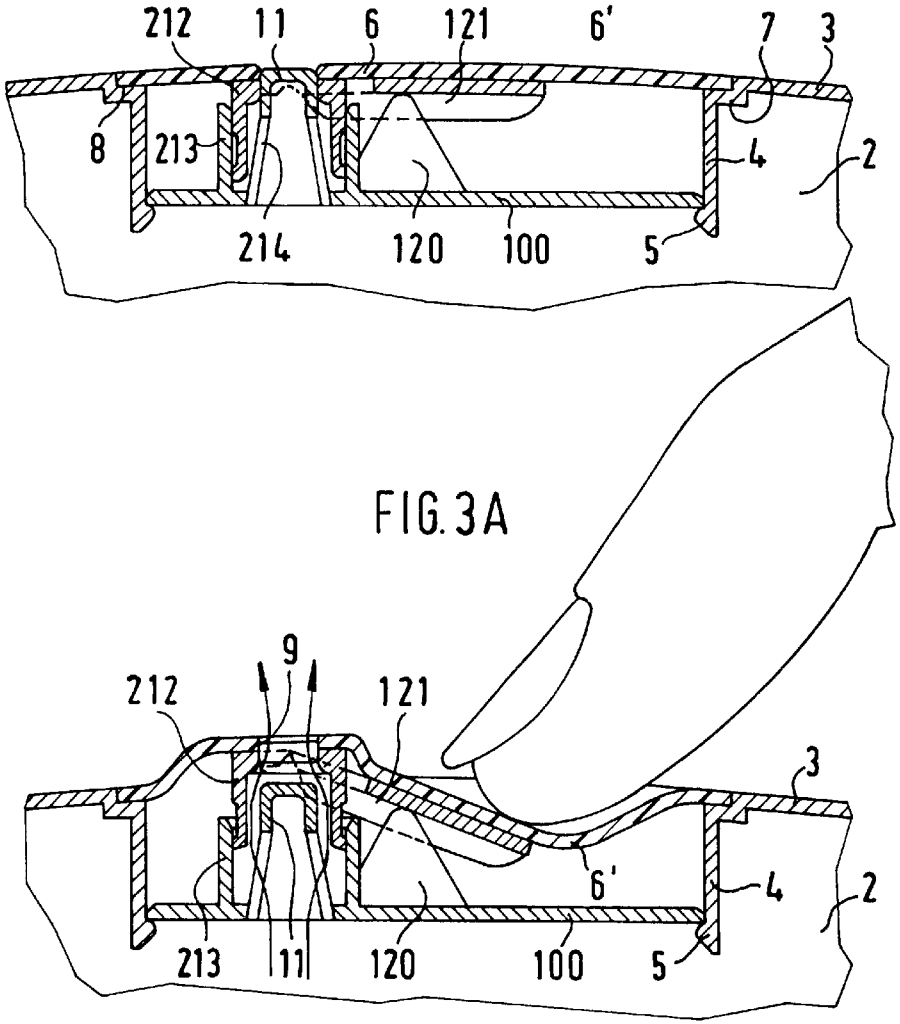

FIGS. 3 and 3A show a third embodiment of the invention wherein same or similar parts bear the same references as was the case in the second embodiment shown in FIGS. 2 and 2A. These parts need not be described again. Basically, the embodiment of FIGS. 3, 3A differs from that of FIGS. 2, 2A in that the rocker member 121 is articulated at one end to a sleeve member 212 which is guided axially in a cylinder member 213 in the manner of a piston-cylinder arrangement, whereby said cylinder member is formed on the inner section 100 of the closure and is concentric relative to the peripherally perforated sealing tappet 11. The sleeve member 212 engages beneath the upper wall section 6 peripherally of the through opening 9 in a manner similar to that of the ring element 123 in the second embodiment. Consequently, a force exerted on the rocker member 121 at one side of the support 120 produces a movement of the sleeve member 212 in the opposite direction and hence a convex protuberance of the upper wall section 6 peripherally of the through opening 9. The movement of the sleeve member 212 is controlled by the interaction with the cylinder member 213.

In the position of the upper wall section 6 near the through opening 9 shown in FIG. 3A, a medium can flow out from the interior of the container 2 along the arrow through apertures 214 in the sealing tappet 11 into the interior of the cylinder member 213, and from there, through the sleeve member 212 and out through the through opening 9.

What is claimed is:

1. A self-closing closure for integration into a discharge opening of a container, including an upper wall section containing a through opening, and a sealing tappet protruding from an inner section of the closure and engaging with the through opening from beneath the upper wall section, said sealing tappet against a bias force being adapted to be moved out of sealing engagement with the through opening by means of a force exerted on the upper wall section wherein the upper wall section, at least on the upper side thereof, is adapted to be matched with the shape of the outer surface of the container for becoming flush therewith, and is elastically deformable at at least an actuating portion thereof, whereby said actuating portion can be deformed in an elastically concave manner by means of an external manual force exerted thereon, and wherein means are provided for converting the concave deformation of the actuating portion into a relative movement between the sealing tappet and the through opening.

2. The closure in accordance with claim 1, wherein the sealing tappet is pivotally held on the inner section of the closure for being pivoted by the actuating portion under the influence of an elastic concave deformation thereof.

3. The closure in accordance with claim 2, wherein a movement conveying member formed on a connecting member linking the sealing tappet to the inner section of the closure, engages from beneath the elastically deformable actuating portion of the upper wall section.

4. The closure in accordance with claim 1, wherein a rocker member pivotally supported on the inner section of the closure with one of the ends thereof engages the actuating portion and the other end engages a portion of the upper wall section disposed circumferentially of the through opening and adapted to bulge out elastically when a force is exerted thereon by the rocker member.

5. The closure in accordance with claim 4, wherein the rocker member is articulated at one end thereof to a sleeve member protruding from the upper wall section, and is accommodated in a cylindrical section protruding from the inner section of the closure in axially movable manner so as to control the bulging of said upper wall section disposed circumferentially of the through opening.

6. The closure in accordance with claim 1, wherein it is a pre-assembled unit adapted to be inserted into the discharge opening.

7. The closure in accordance with claim 1, wherein at least either the upper wall section or the inner section of the closure is an integral element of the component comprising the discharge opening.

* * * * *